United States Patent [19]

Ten Bruggencate et al.

[11] Patent Number: 4,944,399

[45] Date of Patent: Jul. 31, 1990

[54] CONTAINER WITH INTEGRAL FOLDABLE HANDLE

[75] Inventors: Cornelis A. Ten Bruggencate, Alphen; Andréas N. Montijn, Hillegom; Gerrit J. Van Keimpema, Woerden, all of Netherlands

[73] Assignee: Koninklijke Emballage Industrie Van Leer B. V., Amstelveen, Netherlands

[21] Appl. No.: 335,278

[22] Filed: Apr. 10, 1989

[30] Foreign Application Priority Data

Apr. 11, 1988 [NL] Netherlands ..... 8800929

[51] Int. Cl.[5] ..... B65D 21/02; B65D 25/28

[52] U.S. Cl. ..... 206/509; 220/94 A

[58] Field of Search ..... 220/94 A; 206/509

[56] References Cited

U.S. PATENT DOCUMENTS

| | | | |
|---|---|---|---|
| 1,331,409 | 2/1920 | Barnet | 220/94 A |
| 3,387,749 | 6/1968 | Godschalk | 220/94 A |
| 3,401,827 | 9/1968 | Messina | 220/94 A |
| 4,474,303 | 10/1984 | Maccise | 220/94 A |

FOREIGN PATENT DOCUMENTS

| | | |
|---|---|---|
| 0140860 | 5/1985 | European Pat. Off. . |
| 1200730 | 9/1965 | Fed. Rep. of Germany . |
| 3107716 | 9/1982 | Fed. Rep. of Germany . |

*Primary Examiner*—George E. Lowrance

*Attorney, Agent, or Firm*—Brumbaugh, Graves, Donohue & Raymond

[57] ABSTRACT

The invention relates to a container (1) of the type which can be stacked which container has a top surface with a pouring orifice (6) adjacent one edge of the top surface (2) and a handle (9,10) which forms an integral part with the bottom of a recessed portion (8) of the top surface (2,4) and which in its initial or normal starting position extends at a sharp angle with respect to the vertical axis of the container and in a plane which is perpendicular to the plane of symmetry through the vertical axis of the container and the vertical axis of the pouring orifice, which handle may resiliently be bent into an upright gripping position or a downwardly folded storage position in which position it is completely inside the recessed portion.

1 Claim, 2 Drawing Sheets

CONTAINER WITH INTEGRAL FOLDABLE HANDLE

The invention relates to a container comprising a body, a bottom and a top wall having at or adjacent the top wall a pouring orifice which can be closed and which has been located adjacent to the outer edge of the top wall and a handle which is swingable about an axis extending perpendicular to the longitudinal axis of the body and perpendicular to the plane of symmetry of the body through said longitudinal axis and through the axis of the pouring orifice, the pivot axis of the handle being at or adjacent the bottom of a recessed portion of the top wall, the dimensions of said handle being such that it can be taken up entirely within the recessed portion.

A container of this type is known from DE-A-3,107,716. This known container has a handle which is freely pivotable by means of pins which can snap into recesses in the opposite side walls of a recessed portion of the top surface of the container which recessed portion practically can take up the entire handle in its downwardly folded position from which it can be lifted by hand into the upright position for carrying the container.

The pivot axis of the handle extends perpendicular to the plane of symmetry of the container through the axis of the pouring orifice. This position facilitates handling the container in case contents has to be poured out of it. Normally the handle lies in the downwardly folded position and in said position the handle is difficult to grip in particular if the person who has to handle the container wears gloves as is very often the case.

Providing the container with an integral fixed handle would allow easy gripping, but in that case stacking of the container becomes quite impossible whereas manufacturing of the container by means of blow moulding makes it more or less evident to place the handle in the plane of symmetry of the container and not in a plane perpendicular to the plane of symmetry. If the handle is placed in the plane of symmetry the parts of the mould easily can have recesses for forming the handle as well.

An example of a container having an integral handle which forms an integral part with a blow moulded container is found in DE-A-1,200,730.

Purpose of the invention is to provide a container which can be stacked and which has a handle which does not prevent stacking but also allows easy gripping.

This purpose according to the invention is achieved in that the handle forms an integral part of the top wall and has an initial position defined by manufacturing in which the handle extends above the upper edge of the recessed portion and in said position extends in a plane which extends at a sharp angle with the longitudinal axis of the body which handle from said initial position is resiliently swingable between a vertical position for use and the storage position inside the recess portion.

Due to the inclined starting position of the handle said handle need not to be lifted out of the recessed portion and can easily be gripped, also by a hand wearing gloves. Due to the resiliency of the portion of the handle which forms the integral transitional portion of the legs of the bail shaped handle with the bottom of the recess portion of the top surface swinging of the handle towards the upward position or the downwardly folded position is possible. If the handle is gripped to lift the container the handle will swing in the upright substantially vertical position in which position the container can be carried.

If another container is placed on top of the container the handle will be folded downwardly and pushed into the recessed portion so that stacking is not prevented. After lifting the container which has been placed on top of the container according to the invention the handle automatically moves upwardly into the inclined position ready for gripping.

The handle of the container known from DE-A-1,200,730, which handle also forms an integral part with the top surface of the container will also normally by resiliency swing upwardly, however, in a vertical position which prevents stacking even if the shape would allow stacking, whereas in the downwardly folded position the handle has to be locked to keep it in said downwardly folded position. This does not facilitate gripping of the handle.

The container according to the invention has a handle which in the same way as the container according to DE-A-3,107,716 extends in a plane perpendicular to the plane of symmetry. For manufacturing a top surface with an integral handle which in its initial position is inclined to the vertical is not easy to manufacture. A mould is necessary formed of a plurality of inter-engaging parts which are shaped in such a way and partly movable in such a way that loosening of the top surface with handle from the mould is possible. This more complicated mould is , however, necessary only once and the manufacturing of such a mould is known in the art for other purposes.

Preferably according to the invention the bottom of the container has a gripping edge at least at that portion of the bottom which lies on the other side of the container as the pouring orifice. The position of the handle in combination with said gripping edge facilitates emptying of the container.

It moreover is preferred to give the handle a profile with a cross section of an inverted T. A profile of this type not only is favourable to grip by the hand. It is torsion-stiff as well and facilitates loosening from the injection mould. In view of the fact that said handle forms an integral part with the upper surface the T-shaped cross section of the profile of the handle adjacent the bottom of the recessed portion should merge into a flat strip which lies in one and the same plane as the leg of the T-shaped cross section, which flat strip forms the resilient pivotable connection.

The invention will be further elucidated with reference with the drawings.

Figure 1:
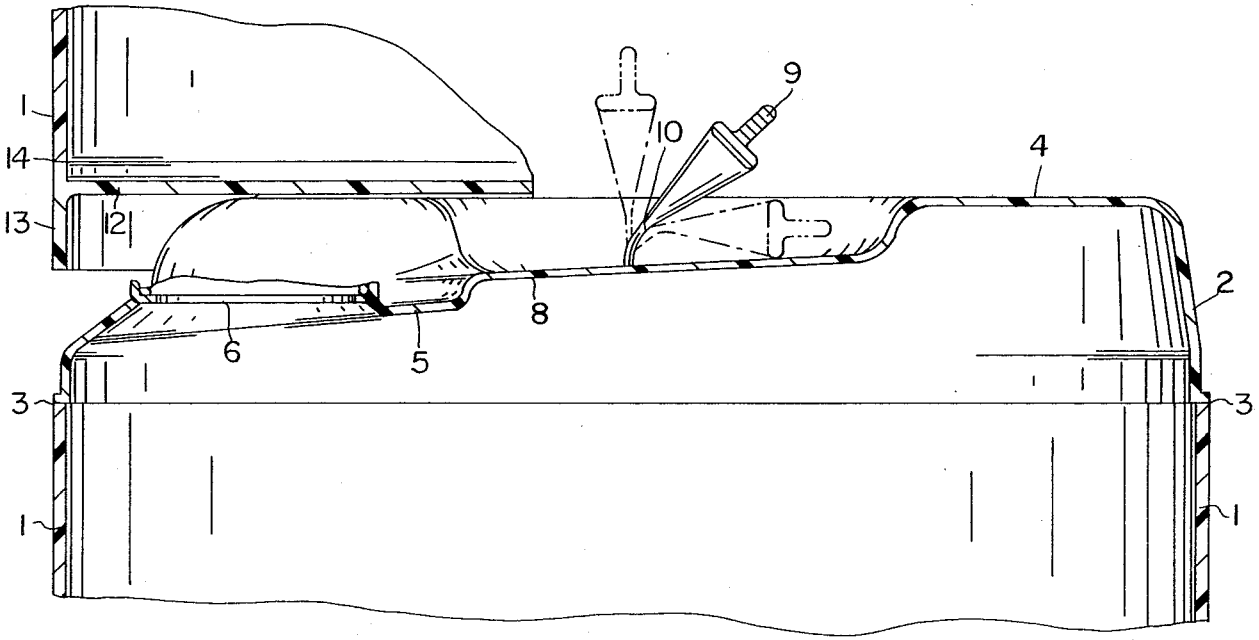
FIG. 1 shows in cross section the upper part of a container with on top of it diagrammatically shown the lower part of a similar container.

FIG. 1 shows a container having a cylindrical body 1 on top of which has been placed an injection moulded upper wall 2 which at 3 is butt welded upon the end edge of the body 1. Said upper wall has an upwardly extending edge which merges into a flat upper surface 4 which has been provided with a recessed portion with a substantially rectangular portion 5 which, at least as shown here, surrounds the pouring orifice 6 which in FIG. 2 has been provided with a closure cap 7. Furthermore said recessed portion comprises a substantially oval part 8 which slopes downwardly towards the portion 5 surrounding the orifice 6.

A handle 9 has been provided in said recessed portion the upper part of which has the shape of an inverted T-shaped cross section whilst the T-shaped legs of it merge into flat strips 10 and 11 respectively.

Figure 2:
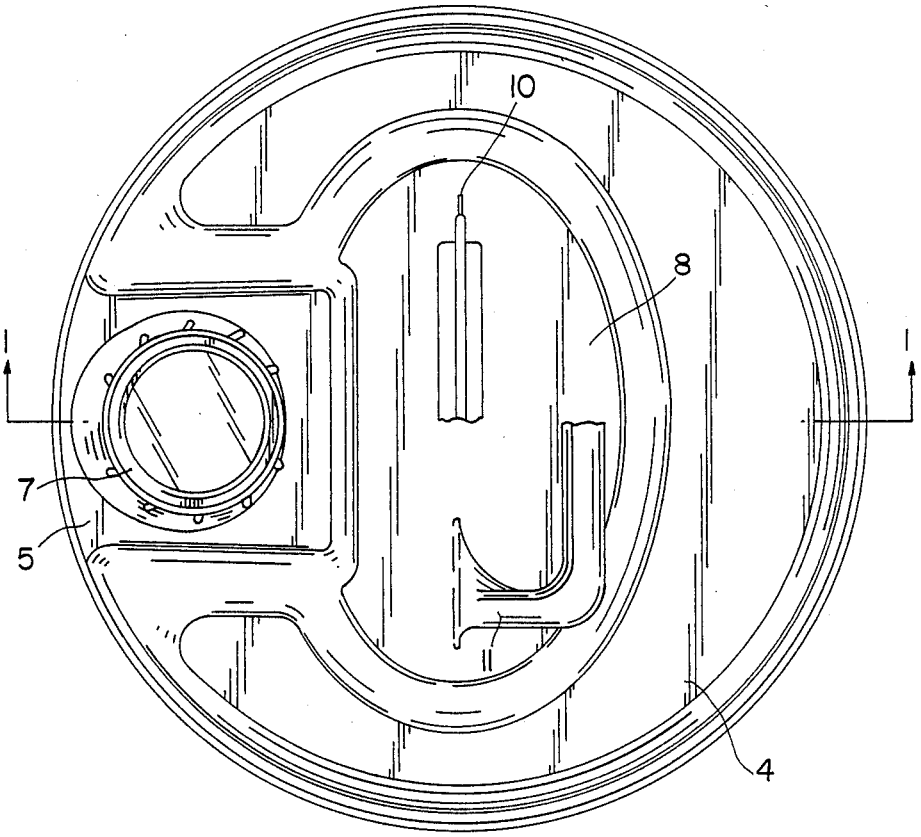
FIG. 2 is a top view of the upper wall of the container of FIG. 1 after removal of the container placed on top of it.

FIG. 1 which shows a cross section according to to the line I—I of FIG. 2 shows the handle 9 in the initial position in uninterrupted lines, in which position the handle extends above the top surface 4 of the upper wall.

If said handle is gripped by the hand, which is easily possible due to the inclined starting position, and the container is lifted at the handle, then the handle swings into the upright position indicated by interrupted lines.

If, however, one places upon the upper wall a similar container with a flat bottom 12 then the handle is pressed downwardly into the position shown at the right side of the inclined position and indicated with interrupted lines, in which position the handle lies completely inside the height of the recessed portion.

The handle accordingly does not prevent stacking and upon removal of the container placed upon it immediately raises in the position indicated in full lines ready for gripping.

The bottom 12 may be provided with a gripping edge 13 and may be at 14 be connected to the body 1 by butt welding. Bottom as well as body may be manufactured from another material than synthetic resin.

We claim:

1. A stackable container for a pourable liquid comprising:

a hollow cylindrical body structure having a longitudinal axis and forming a side wall of the container, a bottom wall joined at an outer edge with the side wall structure near the bottom edge thereof, a top wall structure joined at its periphery with the top edge of the hollow body structure and forming a top wall for the container, said top wall structure having a recessed portion formed in the central region of the top wall for receiving a folded handle and a closable pouring orifice formed adjacent the outer edge of the top wall, said recessed portion having an upper edge and a bottom surface disposed a predetermined distance below the upper edge, and a bail-type handle having legs integrally molded with the bottom surface of the recessed portion of said top wall structure from synthetic resin material and arranged to be swingable about a pivot axis located near said bottom surface and extending perpendicular to the longitudinal axis of said body structure and perpendicular to the plane of symmetry of said body structure through said longitudinal axis and and through the axis of said pouring orifice, said handle being dimensioned to be entirely received within said recess portion when swung downwardly and as released from a mold having a normal position in which the legs extend upwardly in a plane which makes a sharp angle with said longitudinal axis and the handle extends above the upper edge of the recessed portion to facilitate easy gripping of the handle, the transitional portion of the legs with the bottom surface of the recessed portion being sufficiently resilient to swing upwardly from its normal position when the handle is gripped to lift the container and to be urged downwardly to a substantially horizontal position against the bottom surface of the recessed portion to facilitate stacking of like containers and in each case to return to said normal position upon removal of the applied force.

* * * * *